US008020799B2

(12) United States Patent
Muraoka

(10) Patent No.: US 8,020,799 B2
(45) Date of Patent: Sep. 20, 2011

(54) HYDRAULIC CRUSHER

(75) Inventor: Daisuke Muraoka, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 99 days.

(21) Appl. No.: 12/631,204

(22) Filed: Dec. 4, 2009

(65) Prior Publication Data

US 2010/0170974 A1 Jul. 8, 2010

(30) Foreign Application Priority Data

Jan. 5, 2009 (JP) ..... 2009-000401

(51) Int. Cl.
*B02C 19/00* (2006.01)

(52) U.S. Cl. ..... 241/101.73; 241/266

(58) Field of Classification Search ..... 241/101.73, 241/266

See application file for complete search history.

(56) References Cited

U.S. PATENT DOCUMENTS

2006/0032955 A1* 2/2006 Kimura et al. ..... 241/101.73

FOREIGN PATENT DOCUMENTS

JP 2004-68393 3/2004
JP 2008-18364 1/2008

* cited by examiner

*Primary Examiner* — Faye Francis
(74) *Attorney, Agent, or Firm* — Oblon, Spivak, McClelland, Maier & Neustadt, L.L.P.

(57) ABSTRACT

A hydraulic crusher includes crushing arms, a crusher body having a hollow portion extending in the longitudinal direction, and hydraulic cylinders. The hydraulic crusher includes four first hydraulic hoses which have proximal caps connected to ports of the crusher body and extend toward the distal side in the longitudinal direction in the hollow portion; four second hydraulic hoses which have proximal caps connected to ports of the hydraulic cylinders, and extend into the hollow portion and then toward the distal side in the longitudinal direction while being curved; and a clamp or the like serving as a joint member movable in the longitudinal direction, the clamp connecting distal sections of the first hydraulic hoses with distal sections of the second hydraulic hoses.

7 Claims, 8 Drawing Sheets

HYDRAULIC CRUSHER

BACKGROUND OF THE INVENTION

1. Field of the Invention

The present invention relates to a hydraulic crusher attached to a distal section of an arm of a working machine such as a hydraulic excavator, and used for demolition etc. of a structure.

2. Description of the Related Art

Hitherto, demolition of a concrete structure etc. has been performed by using a large-scale breaker or a hydraulic crusher attached to a distal section of an arm of a hydraulic excavator. In particular, when demolition is performed in, for example, an urban area, a hydraulic crusher is frequently used because the hydraulic crusher has measures to reduce dust, vibration, and noise as compared with the large-scale breaker.

A hydraulic crusher typically includes a pair of crushing arms that crush an object to be crushed, a crusher body a distal section of which supports the crushing arms in an openable and closable manner around pivots, and a pair of hydraulic cylinders coupled to proximal section of the crusher body and to the crushing arms respectively rotatably around pivots. Hydraulic hoses that connect ports at the proximal section of the crusher body with ports at proximal sections of the hydraulic cylinders are formed between the distal section and the proximal section of the crusher body to prevent the hydraulic hoses from being damaged because of collision with scattering crushed pieces. Also, major parts of the hydraulic hoses are housed in a hollow portion surrounded by cover plates (for example, see Japanese Unexamined Patent Application Publication Nos. 2004-68393 and 2008-18364).

In this hydraulic cylinder, the crushing arms are opened when piston rods of the hydraulic cylinders are accommodated in cylinder bodies, and the crushing arms are closed when the piston rods protrude from the cylinder bodies. The concrete structure etc. gripped by the open crushing arms is crushed by the crushing arms when the crushing arms are closed.

However, in the hydraulic crusher of the related art, the hydraulic crusher attached to the distal section of the arm of the working machine is very compact. When a port of the crusher body is directly connected to a port of the hydraulic cylinder through a single hydraulic hose, the hydraulic hose is bent with a small bend radius in the hollow portion of the crusher body. The hydraulic hose may be damaged.

Also, since the hydraulic hose is housed in the hollow portion of the crusher body in a constrained manner, it may be difficult to replace a damaged hydraulic hose with new one.

In light of the situations, a hydraulic crusher shown in FIG. 8 may be conceived. The hydraulic crusher effectively uses the hollow portion of the crusher body. For the convenience of viewing, FIG. 8 does not illustrate a frame or a part of a cover member which define a crusher body 105.

In this hydraulic crusher 101, hydraulic hoses that connect the crusher body 105 with hydraulic cylinders 103 are divided into first hydraulic hoses 107, 117, 127, and 137 which are connected to ports (not shown) of the crusher body 105, and second hydraulic hoses 109, 119, 129, and 139 which are connected to ports (not shown) of the hydraulic cylinders 103. Also, a joint block 131 is provided in a distal section of a hollow portion 165 of the crusher body 105. Distal sections of the first hydraulic hoses 107, 117, 127, and 137 are connected to distal sections of the second hydraulic hoses 109, 119, 129, and 139.

With this hydraulic crusher 101, the hydraulic hoses that connect the crusher body 105 with the hydraulic cylinders 103 are divided into the first hydraulic hoses 107, 117, 127, and 137 and the second hydraulic hoses 109, 119, 129, and 139. Thus, the first and second hydraulic hoses 107, 117, 127, and 137 and 109, 119, 129, and 139 each can be easily replaced with new one. In addition, the distal sections of the first hydraulic hoses 107, 117, 127, and 137 are connected to the distal sections of the second hydraulic hoses 109, 119, 129, and 139 through the joint block 131. Thus, the first and second hydraulic hoses 107, 117, 127, and 137 and 109, 119, 129, and 139 do not have to be bent with a small bend radius. The first and second hydraulic hoses 107, 117, 127, and 137 and 109, 119, 129, and 139 can be prevented from being damaged.

Since the opposite ends of the first hydraulic hoses 107, 117, 127, and 137 are fixed, the first hydraulic hoses 107, 117, 127, and 137 are not moved although the crushing arms 111 are opened and closed. Thus, as long as the length of the second hydraulic hoses 109, 119, 129, and 139 is a length that prevents the second hydraulic hoses 109, 119, 129, and 139 from interfering with the first hydraulic hoses 107, 117, 127, and 137, more particularly, a length that prevents the second hydraulic hoses 109, 119, 129, and 139 from being loosened and curved even when the crushing arms 111 are closed, the first and second hydraulic hoses 107, 117, 127, and 137, and 109, 119, 129, and 139 can be prevented from being rubbed on one another and hence being damaged.

However, in the hydraulic crusher 101 having the joint block 131 at the distal section of the crusher body 105, the other problems may come up as follows. The length of the second hydraulic hoses 109, 119, 129, and 139 is limited so as not to be loosened and curved even when the crushing arms 111 are closed. Thus, when the crushing arms 111 are closed, that is, when the hydraulic cylinders 103 are opened to be widened toward the distal side, the second hydraulic hoses 109, 119, 129, and 139 are pulled and become tensed between the hydraulic cylinders 103 and the joint block 131. The second hydraulic hoses 109, 119, 129, and 139 tend to be damaged.

The second hydraulic hoses 109, 119, 129, and 139 only have small flexibility because the opposite ends of the second hydraulic hoses 109, 119, 129, and 139 are fixed. When the hydraulic cylinders 103 are contracted (when the cylinder bodies 113 are moved toward the proximal side so as to accommodate the piston rods, not shown), crushed pieces or the like may be stacked between the cylinder bodies 113 and the second hydraulic hoses 109, 119, 129, and 139. The second hydraulic hoses 109, 119, 129, and 139 may be damaged.

SUMMARY OF THE INVENTION

An object of the present invention is to provide a hydraulic crusher attached to a distal section of an arm of a working machine, the hydraulic crusher which can prevent a hydraulic hose from being damaged and facilitate replacement of the hydraulic hose.

In the hydraulic crusher provided by the present invention, a first hydraulic hose, which is connected to a port of a crusher body, is connected with a second hydraulic hose, which is connected to a port of a hydraulic cylinder, through joint means provided in a hollow portion of the crusher body. The hydraulic hoses can be prevented from being bent with an excessively small bend radius. Also, by moving the joint means in the longitudinal direction, flexibility of the hydraulic hoses can be maintained.

According to an aspect of the present invention, a hydraulic crusher is detachably attached to a distal section of an arm of a working machine. The hydraulic crusher includes a pair of crushing arms, a crusher body, a pair of hydraulic cylinders, a plurality of first hydraulic hoses, a plurality of second hydraulic hoses, and joint means. The crushing arms are configured to grip and crush an object to be crushed. A proximal section of the crusher body is attached to the distal section of the arm of the working machine. The proximal section of the crusher body has ports. A distal section of the crusher body supports the crushing arms in an openable and closable manner around pivots. The crusher body has a hollow portion between the distal section and the proximal section of the crusher body. The hollow portion extends in a longitudinal direction defined by connecting the distal section with the proximal section of the crusher body. Proximal sections of the hydraulic cylinders are coupled to the proximal section of the crusher body outside the hollow portion rotatably around pivots. The proximal sections of the hydraulic cylinders have ports. Distal sections of the hydraulic cylinders are respectively coupled to the crushing arms rotatably around pivots. The first hydraulic hoses have proximal caps connected to the ports at the proximal section of the crusher body. The first hydraulic hoses extend toward a distal side in the longitudinal direction in the hollow portion. The second hydraulic hoses have proximal caps connected to the ports at the proximal sections of the hydraulic cylinders. The second hydraulic hoses extend into the hollow portion and then extend toward the distal side in the longitudinal direction while being curved. The joint means is movable in the longitudinal direction in the hollow portion. The joint means connects distal sections of the first hydraulic hoses with distal sections of the second hydraulic hoses.

In this case, the hydraulic hoses that connect the crusher body with the hydraulic cylinders are divided into the first hydraulic hoses connected to the ports at the proximal section of the crusher body, and the second hydraulic hoses connected to the ports at the proximal sections of the hydraulic cylinders. The distal sections of the first hydraulic hoses are connected to the distal sections of the second hydraulic hoses through the joint means. Thus, the first and second hydraulic hoses do not have to be bent with an unreasonable bend radius of a predetermined minimum bend radius or smaller. The first and second hydraulic hoses can be prevented from being damaged.

When the hydraulic cylinders are opened to be widened toward the distal side, the second hydraulic hoses are pulled in a direction in which the hydraulic cylinders are opened by following the movement of the hydraulic cylinders. However, since the second hydraulic hoses extend into the hollow portion of the crusher body and then extend toward the distal side in the longitudinal direction while being curved, the force that pulls the second hydraulic hoses in the direction in which the hydraulic cylinders are opened is converted into the force that pulls the second hydraulic hoses toward the proximal side in the longitudinal direction. In this case, since the second hydraulic hoses are connected to the joint means that is movable in the longitudinal direction in the hollow portion, even when the second hydraulic hoses are pulled toward the proximal side in the longitudinal direction, the second hydraulic hoses do not become tensed between the hydraulic cylinders and the joint means.

Since the distal sections of the second hydraulic hoses are connected to the joint means that is movable in the longitudinal direction, and hence the second hydraulic hoses are flexible, when the hydraulic cylinders are contracted, crushed pieces or the like do not tend to be stacked between the hydraulic cylinders and the second hydraulic hoses connected thereto. Even if the crushed pieces or the like are stacked between the hydraulic cylinders and the second hydraulic hoses, the second hydraulic hoses do not tend to be damaged because of the flexibility thereof.

The second hydraulic hoses connected to the ports of the hydraulic cylinders may be more frequently damaged as compared with the first hydraulic hoses connected to the ports of the crusher body. However, since the distal sections of the second hydraulic hoses are connected to the joint means that is movable in the longitudinal direction, the replacement of the second hydraulic hoses can be facilitated.

In the above configuration of the aspect, the joint means may bind the distal sections and/or portions near the distal sections of the second hydraulic hoses such that the distal sections of the second hydraulic hoses are separated from the distal sections of the first hydraulic hoses by a predetermined distance.

Meanwhile, in the hydraulic crusher described in the related art, the pair of hydraulic cylinders symmetrically rotate around pivots of the crusher body by following the opening and closing operation of the pair of crushing arms. Thus, the hydraulic hoses connected to the hydraulic cylinders are moved by following the hydraulic cylinders. The hydraulic hoses may be rubbed on one another and damaged.

With the above configuration of the aspect, the joint means binds the distal sections and/or the portions near the distal sections of the second hydraulic hoses such that the distal sections of the second hydraulic hoses are separated from the distal sections of the first hydraulic hoses by a predetermined distance. Accordingly, the second hydraulic hoses can be prevented from being irregularly moved as a result of the movement of the hydraulic cylinders. That is, the joint means suppresses the movement of the second hydraulic hoses pulled by the hydraulic cylinders.

Also, the joint means is moved toward the proximal side in the longitudinal direction without being inclined, the first hydraulic hoses connected to the joint means are not excessively bent or twisted. The first hydraulic hoses can be uniformly bent. Thus, the first hydraulic hoses can be prevented from being too close to the second hydraulic hoses. The first hydraulic hoses can be prevented from being rubbed on and damaged by the second hydraulic hoses.

In the above configuration of the aspect, the joint means may more preferably bind the distal sections and/or portions near the distal sections of the second hydraulic hoses such that the second hydraulic hoses are separated from one another.

In this case, the joint means binds the distal sections and/or the portions near the distal sections of the second hydraulic hoses such that the second hydraulic hoses are separated from one another. Thus, the second hydraulic hoses can be prevented from being damaged because the second hydraulic hoses repeatedly contact one another and are repeatedly separated from one another by following the opening and closing operation of the crushing arms.

In the above configuration of the aspect, the joint means may be disconnected from the crusher body.

In this case, since the joint means is disconnected from the crusher body, for example, an impact due to collision between the crushing arms and an object to be crushed can be prevented from being directly transmitted to the joint means. Even if the crushed pieces hit the member defining the hollow portion of the crusher body, and the member is damaged, the joint means tends to avoid the damage. Accordingly, the joint means can be prevented from being broken, and hence the hydraulic hoses can be further reliably prevented from being damaged.

In the above configuration of the aspect, the first hydraulic hoses may have distal caps coupled to the joint means rotatably relative to the joint means.

In this case, the distal caps of the first hydraulic hoses are coupled to the joint means rotatably relative to the joint means. Thus, the first hydraulic hoses can be prevented from being twisted. Accordingly, although the opening and closing operation of the crushing arms and the movement of the joint means in the longitudinal direction are carried out repeatedly, the first hydraulic hoses can be reliably prevented from being damaged.

In the above configuration of the aspect, the joint means may include elbow-shaped distal caps of the second hydraulic hoses, a clamp that binds the distal caps and/or portions near the distal caps of the second hydraulic hoses, and connectors to which the distal caps of the second hydraulic hoses are connected in a direction orthogonal to the longitudinal direction, and to which distal caps of the first hydraulic hoses are connected from the proximal side in the longitudinal direction.

In this case, the joint means includes general parts such as the elbow-shaped distal caps of the second hydraulic hoses, the clamp that binds the distal caps and/or the portions near the distal caps, and the connectors having the elbow-shaped through holes. The joint means can be provided easily with low cost.

In the above configuration of the aspect, the clamp may have a plurality of through holes separated from one another in a plane orthogonal to the longitudinal direction and extending in the longitudinal direction. The distal caps and/or the portions near the distal caps of the second hydraulic hoses may be fitted into the through holes.

In this case, the simply structured clamp can bind the distal caps and/or the portions near the distal caps of the second hydraulic hoses. In particular, if the clamp is used when the joint means binds the distal sections and/or portions near the distal sections of the second hydraulic hoses such that the second hydraulic hoses are separated from one another, the distal sections of the second hydraulic hoses can be separated from the distal sections the first hydraulic hoses by a predetermined distance, and the second hydraulic hoses can be separated from one another.

DESCRIPTION OF THE PREFERRED EMBODIMENTS

Embodiments of the present invention will be described below with reference to the attached drawings.

Figure 1:
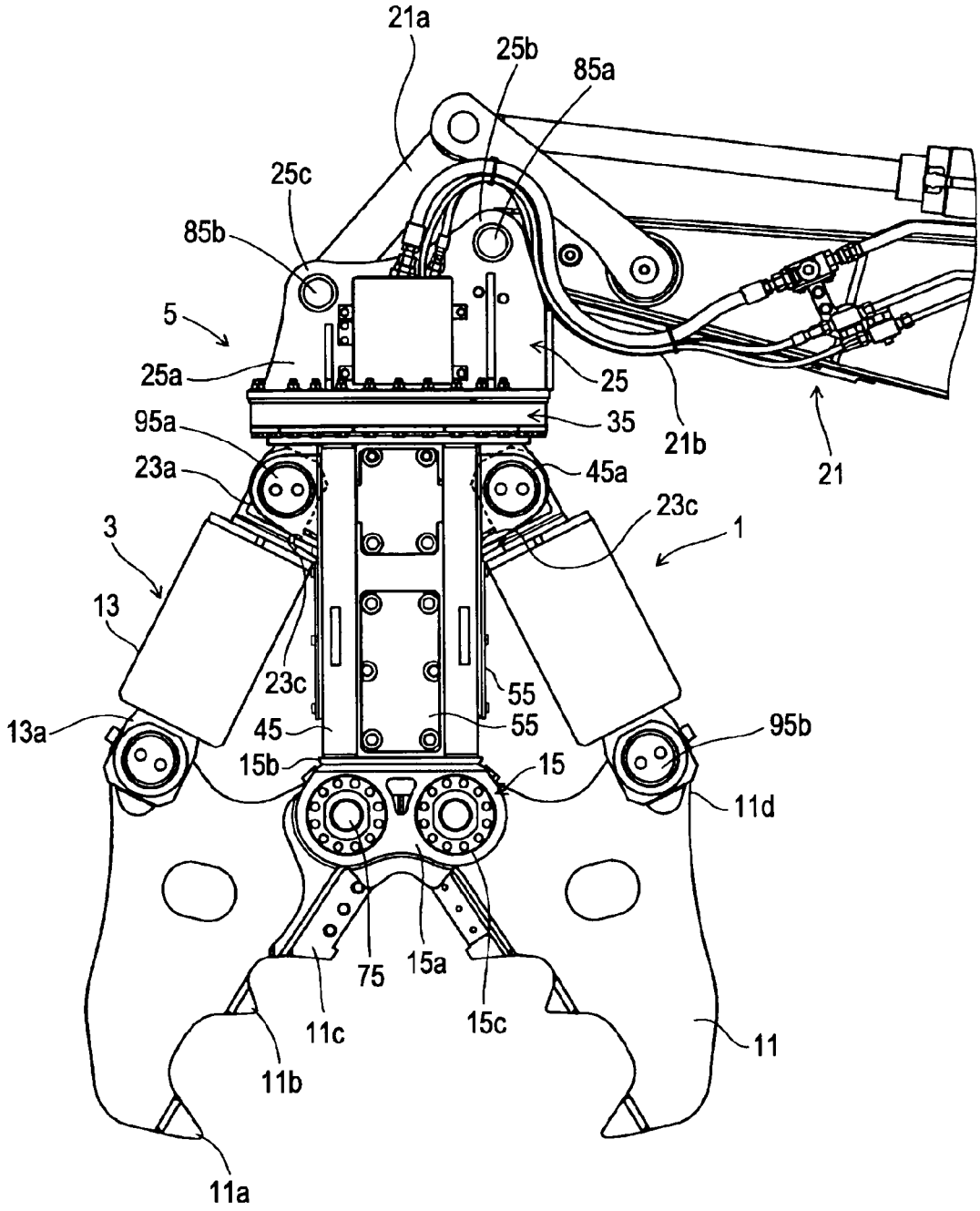
FIG. 1 is a front view showing a hydraulic crusher according to an embodiment of the present invention, the hydraulic crusher attached to a hydraulic excavator.
Figure 2:
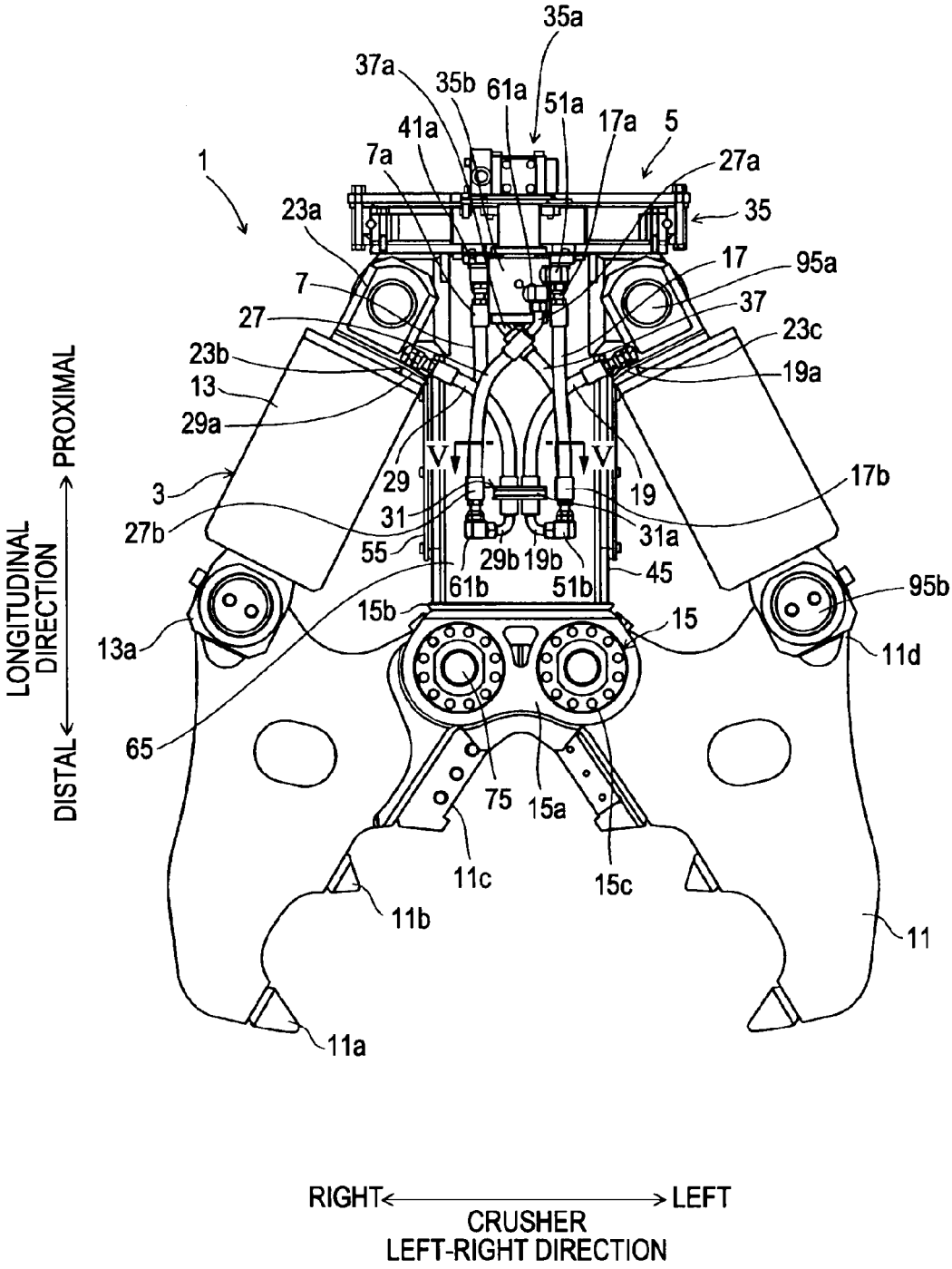
FIG. 2 is a front view showing the hydraulic crusher when crushing arms are open.
Figure 3:
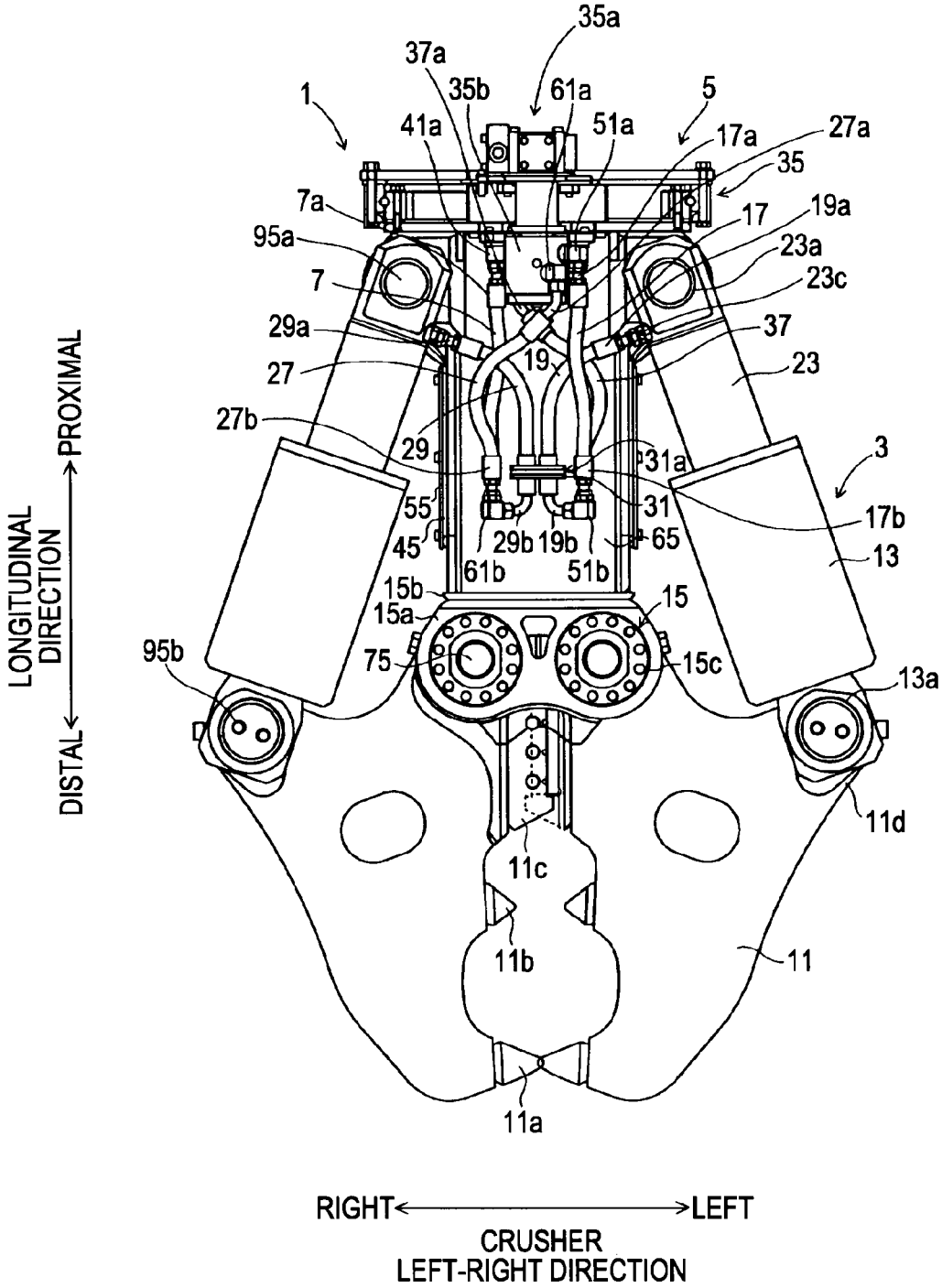
FIG. 3 is a front view showing the hydraulic crusher when the crushing arms are closed.
Figure 4:
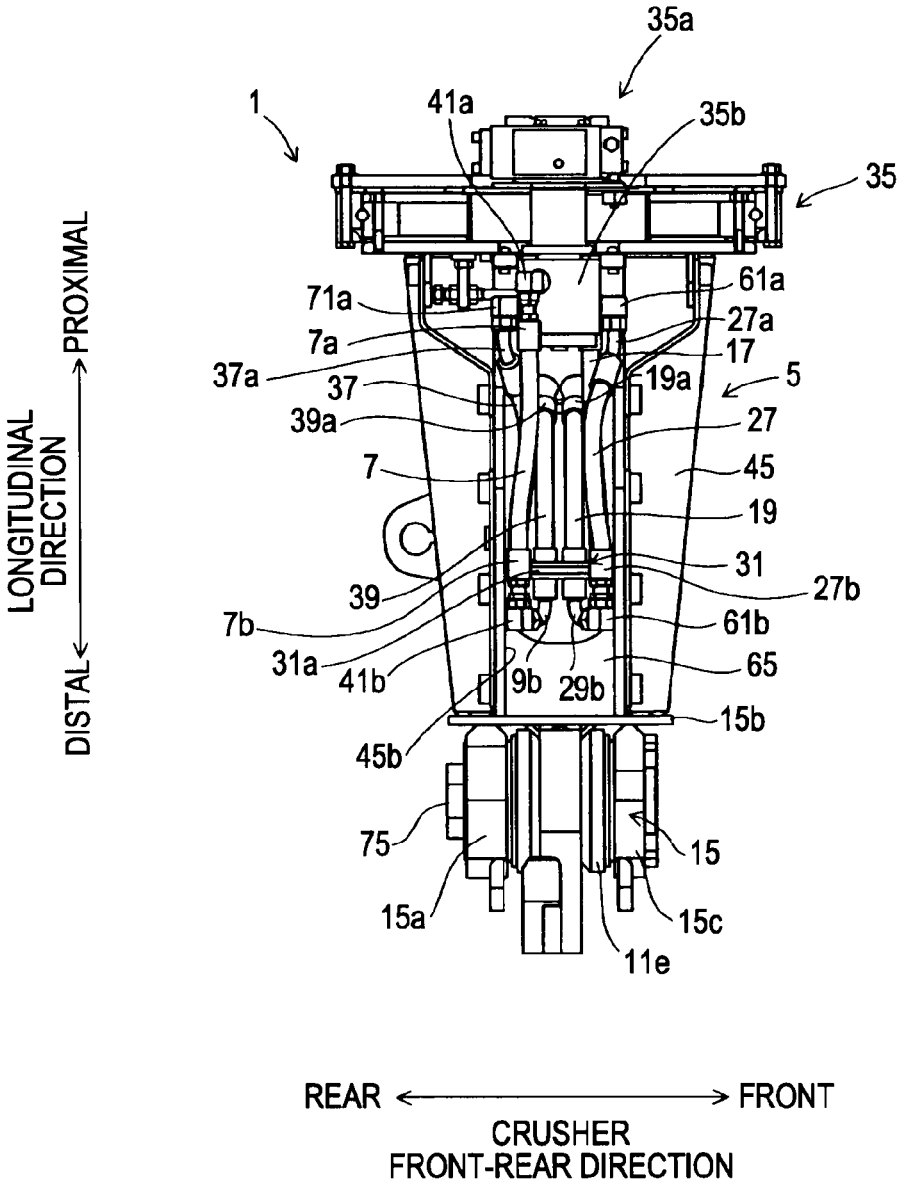
FIG. 4 is a side view showing the hydraulic crusher when the crushing arms are closed.
Figure 5:
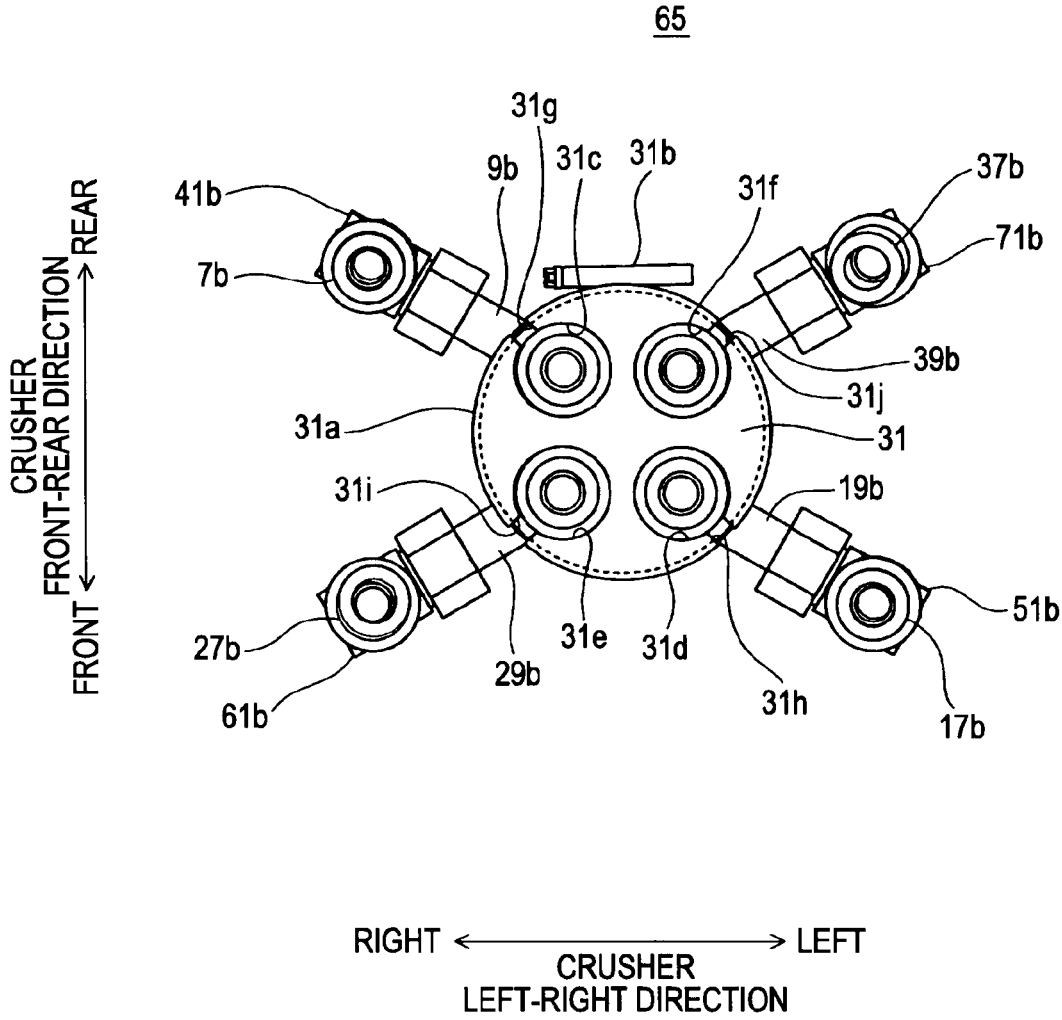
FIG. 5 is a sectional view taken along line V-V in FIG. 2.

FIG. 1 illustrates a hydraulic crusher attached to a hydraulic excavator. FIG. 2 is a front view showing the hydraulic crusher when crushing arms are open. FIG. 3 is a front view showing the hydraulic crusher when the crushing arms are closed. FIG. 4 is a side view showing the hydraulic crusher when the crushing arms are closed. FIG. 5 is a sectional view taken along line V-V in FIG. 2. For the convenience of viewing, FIGS. 2 to 4 do not illustrate a part of a cover plate 55 or an attaching bracket 25, and FIG. 4 does not illustrate part of crushing arms 11 or a hydraulic cylinder 3.

Referring to FIG. 1, a hydraulic crusher 1 of this embodiment is attached to a distal section of an arm 21 of the hydraulic excavator through an attaching bracket 25. The hydraulic crusher 1 can be detachably attached to the arm 21, and hence the hydraulic crusher 1 can be replaced with a head attachment such as a bucket.

Referring to FIGS. 1 to 5, the hydraulic crusher 1 includes a crusher body 5; a pair of crushing arms 11 supported at a distal section of the crusher body 5; a pair of hydraulic cylinders 3 respectively coupled to the crushing arms 11 and coupled to a proximal section of the crusher body 5; four first hydraulic hoses 7, 17, 27, and 37 proximal sections of which are connected to the crusher body 5; four second hydraulic hoses 9, 19, 29, and 39 proximal sections of which are connected to the hydraulic cylinders 3; a clamp 31 that binds the second hydraulic hoses 9, 19, 29, and 39; and four distal connectors 41*b*, 51*b*, 61*b*, and 71*b* that connect distal sections of the first hydraulic hoses 7, 17, 27, and 37 respectively with distal sections of the second hydraulic hoses 9, 19, 29, and 39.

The crusher body 5 includes a supporting bracket 15 (the distal section of the crusher body 5) that supports the pair of crushing arms 11 in an openable and closable manner by arm coupling pins 75; the attaching bracket 25 (the proximal section of the crusher body 5) that is attached to the distal section of the arm 21 of the hydraulic excavator by a first coupling pin 85*a*; a swivel unit 35 provided at the distal side of the attaching bracket 25; a frame 45 extending in the longitudinal direction (a direction defined by connecting the supporting bracket 15 with the swivel unit 35) and coupling the swivel unit 35 with the supporting bracket 15; and a cover plate 55 attached to the frame 45. In the description given below, the extending direction of the arm coupling pins 75 represents the crusher front-rear direction, and the direction orthogonal to the longitudinal direction and to the crusher front-rear direction represents the crusher left-right direction.

The supporting bracket 15 includes side plates 15*a* and a supporting plate 15*b*. The side plates 15*a* are arranged to face each other in the crusher front-rear direction with the pair of crushing arms 11 interposed therebetween. Each of the side plates 15*a* has an almost figure-of-eight shape and has two bosses 15*c* arranged side by side in the crusher left-right direction. The supporting plate 15*b* couples proximal ends in the longitudinal direction of the side plates 15*a* with each other. Thus, the supporting bracket 15 has an almost C shape when viewed in the crusher left-right direction.

The attaching bracket 25 is secured to a proximal end in the longitudinal direction of the swivel unit 35 by bolts. The attaching bracket 25 includes side plates 25*a* arranged to face each other with the distal section of the arm 21 of the hydraulic excavator interposed therebetween. Each of the side plates 25*a* has first and second bosses 25*b* and 25*c*. The attaching bracket 25 is rotatably supported by the distal section of the arm 21 of the hydraulic excavator by the first coupling pin 85*a* that is inserted through the first bosses 25*b*. Also, the attaching bracket 25 is coupled to a linkage 21*a* provided at the arm 21 of the hydraulic excavator by a second coupling pin 85*b* that is inserted through the second bosses 25*c*. Thus, the hydraulic crusher 1 rotates upward and downward around the first coupling pin 85*a* by following the movement of the linkage 21*a*. For example, when the arm 21 of a working machine is horizontally arranged, the hydraulic crusher 1 can grip an object to be crushed located at a position above or below the arm 21.

The swivel unit 35 has a rotary bearing and hence is rotatable relative to the attaching bracket 25. The frame 45 provided at the distal side in the longitudinal direction of the swivel unit 35 rotates around the rotation axis of the swivel unit 35. The swivel unit 35 includes a swivel joint 35*a* arranged in the swivel unit 35. The swivel joint 35*a* connects hydraulic hoses 21*b* (more specifically, hydraulic hoses located near the hydraulic cylinders 3 with respect to a speed increasing valve (see FIG. 6)) with the first hydraulic hoses 7, 17, 27, and 37. The hydraulic hoses 21*b* are provided at the arm 21 of the working machine and hence included in a stationary section. The first hydraulic hoses 7, 17, 27, and 37 are included in a movable section. A rotary cylinder 35*b* is provided in the movable section with respect to the swivel joint 35*a*. The rotary cylinder 35*b* has four hydraulic ports 35*c*, 35*d*, 35*e*, and 35*f* (ports provided at the proximal section of the crusher body 5 (see FIG. 6)), through which hydraulic oil is supplied to or drained from the hydraulic cylinders 3.

The frame 45 is a hollow truncated square pyramid that is rectangular in front view (when viewed in the crusher front-rear direction) and that is trapezoidal in side view (when viewed in the crusher left-right direction) in such a manner as the width of the frame 45 decreases toward the distal side. The frame 45 has therein a hollow portion 65 extending in the longitudinal direction. The frame 45 has front, rear, left, and right side surfaces each having an opening 45*b* for cleaning of the inside of the hollow portion 65 and for maintenance of piping. Each opening 45*b* is covered with the cover plate 55. The cover plate 55 is secured to the frame 45 by bolts. Thus, for example, scattered concrete pieces (crushed pieces) can be prevented from entering the hollow portion 65. Also, bosses 45*a* are provided at both left and right side surfaces of the frame 45. On either side, the bosses 45*a* face each other in the crusher front-rear direction with corresponding one of proximal bosses 23*a* (which will be described later) of the hydraulic cylinders 3 interposed therebetween.

The crushing arms 11 grip and crush an object to be crushed, such as a concrete structure. The crushing arms 11 are rotatably supported by the crusher body 5 because inner bosses 11*e* provided at the proximal end in the longitudinal direction are respectively coupled to the bosses 15*c* of the supporting bracket 15 by arm coupling pins 75. The crushing arms 11 rotate in opposite directions around the arm coupling pins 75. Thus, the pair of crushing arms 11 are opened or closed in the crusher left-right direction.

The crushing arms 11 have distal teeth 11*a* and 11*b* at distal sections and center sections in the longitudinal direction of the inner edges in the crusher left-right direction of the crushing arms 11 (at the edge at which the crushing arm 11 overlaps with the other crushing arm 11 when being closed). The distal teeth 11*a* and 11*b* firmly grip an object to be crushed. In addition, the crushing arms 11 have cutters 11*c* at proximal sections in the longitudinal direction of the crushing arms 11. The cutters 11*c* cut a reinforcing steel bar protruding from a crushed concrete structure. Also, the crushing arms 11 have outer bosses 11*d* at proximal sections in the longitudinal direction of the outer edges in the crusher left-right direction of the crushing arms 11. The hydraulic cylinders 3 are coupled to the outer bosses 11*d*.

Figure 6:
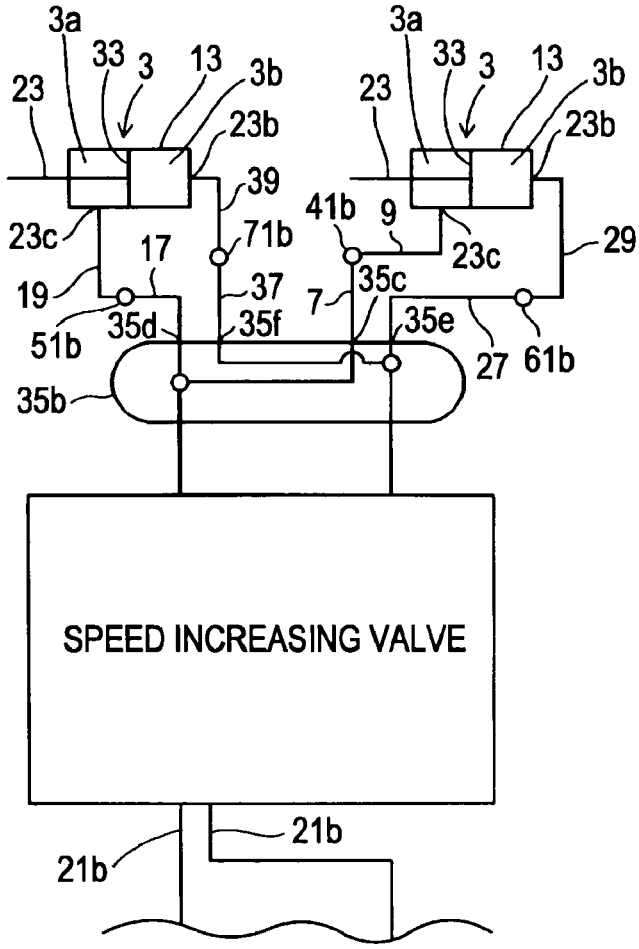
FIG. 6 is a hydraulic circuit diagram of the hydraulic crusher.
Figure 7:
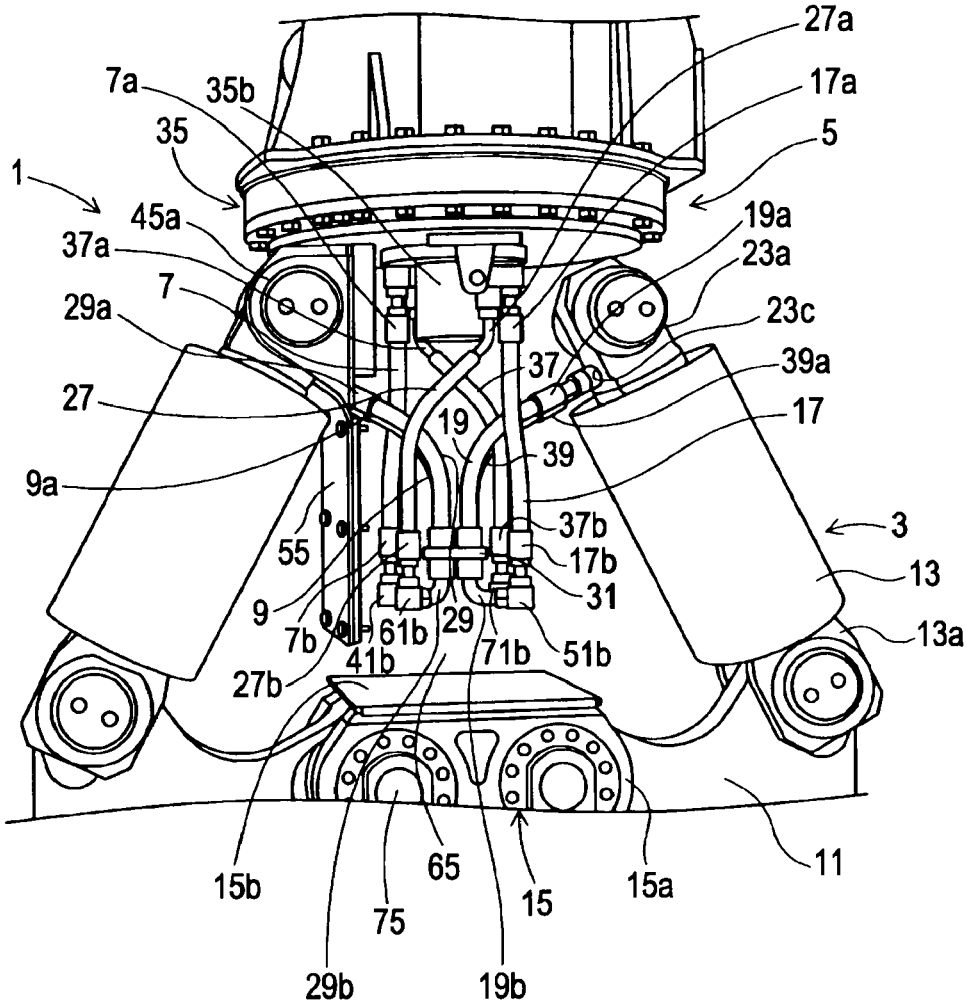
FIG. 7 is a perspective view schematically showing the piping structure of the hydraulic crusher.
Figure 8:
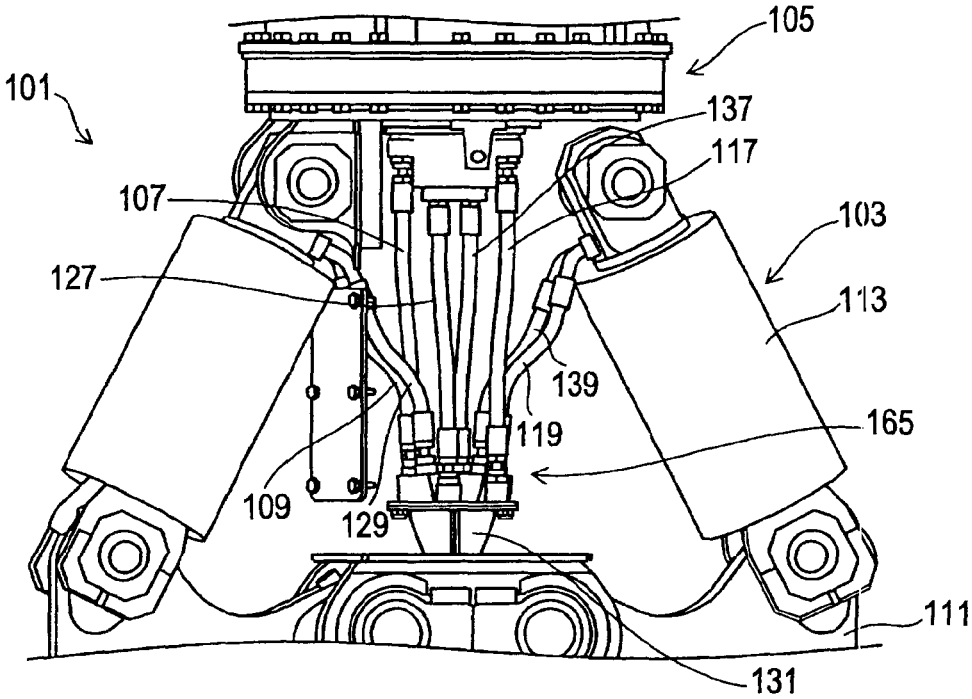
FIG. 8 Prior Art
FIG. 8 is a perspective view schematically showing the piping structure of a hydraulic crusher of related art, the hydraulic crusher being provided with a joint block.

Referring to FIGS. 3 and 6, the hydraulic cylinders 3 each include a cylinder body 13, a piston rod 23, and a piston 33. Since both hydraulic cylinders 3 have similar structures, one of the hydraulic cylinders 3 will be described below.

The cylinder body 13 has a cylindrical shape with the top and bottom. The cylinder body 13 has two distal bosses 13*a* at a distal section of the cylinder body 13. The distal bosses 13*a* face each other in the crusher front-rear direction with the outer boss 11*d* of the corresponding crushing arm 11 interposed therebetween. The piston 33 is arranged in the cylinder body 13 slidably along the axis of the cylinder body 13. The piston 33 divides the inner space of the cylinder body 13 into a head-side oil chamber 3*b* located at the distal side and a rod-side oil chamber 3*a* located at the proximal side.

The piston rod 23 is slidably fitted into the cylinder body 13. The distal section of the piston rod 23 is coupled to the piston 33. The proximal section of the piston rod 23 has a proximal boss 23*a*. The proximal boss 23*a* is coupled to the corresponding boss 45*a* of the frame 45. Also, the piston rod 23 has a head-side hydraulic port 23*b* and a rod-side hydraulic port 23*c* (a port provided at the proximal section of the hydraulic cylinder 3) near the proximal boss 23*a*. The head-side hydraulic port 23*b* communicates with the head-side oil chamber 3*b* through a first oil channel (not shown) formed in the piston rod 23, and also communicates with the rod-side oil chamber 3*a* through a second oil channel (not shown) formed in the piston rod 23.

In the hydraulic cylinders 3 thus configured, the proximal bosses 23*a* (the proximal sections) of the hydraulic cylinders 3 are coupled to the bosses 45*a* of the frame 45 (the proximal section of the crusher body 5) outside the hollow portion 65 rotatably by coupling pins 95*a*. Also, the distal bosses 13*a* (the distal sections) of the hydraulic cylinders 3 are coupled to the outer bosses 11*d* of the crushing arms 11 rotatably by coupling pins 95*b*.

When the hydraulic oil is supplied to the rod-side oil chambers 3*a* from the rod-side hydraulic ports 23*c*, the piston rods 23 slide in the cylinder bodies 13 toward the distal side and the hydraulic cylinders 3 are contracted. Accordingly, the crushing arms 11 are opened in the crusher left-right direction (see FIG. 2). In contrast, when the hydraulic oil is supplied to the head-side hydraulic chambers 3*b* from the head-side hydraulic ports 23*b*, the piston rods 23 slide in the cylinder bodies 13 toward the proximal side and the hydraulic cylinders 3 are expanded. Accordingly, the crushing arms 11 are closed in the crusher left-right direction (see FIG. 3). The hydraulic cylinders 3 can rotate around the coupling pins 95*a* by following the opening and closing operation of the crushing arms 11. The hydraulic cylinders 3 are closed as shown in FIG. 2 when the crushing arms 11 are opened, whereas the hydraulic cylinders 3 are opened to be widened toward the distal side as shown in FIG. 3 when the crushing arms 11 are closed.

The first hydraulic hoses 7, 17, 27, and 37 are flexible rubber hoses. The first hydraulic hoses 7, 17, 27, and 37 include left and right first rod-side hydraulic hoses 7 and 17 that supply the hydraulic oil to and drain the hydraulic oil from the rod-side oil chambers 3*a* of the hydraulic cylinders 3; and left and right first head-side hydraulic hoses 27 and 37 that supply the hydraulic oil to and drain the hydraulic oil from the head-side oil chambers 3*b* of the hydraulic cylinders 3.

The first rod-side hydraulic hoses 7 and 17 have proximal caps 7*a* and 17*a* and distal caps 7*b* and 17*b* having straight shapes (shapes without a bent portion). The proximal caps 7*a* and 17*a* are connected to the proximal hydraulic ports 35*c* and 35*d* provided at the swivel joint 35*a* (the proximal section of the crusher body 5) through proximal connectors 41*a* and 51*a*. The first rod-side hydraulic hoses 7 and 17 extend in the hollow portion 65 in substantially straight from the proximal connectors 41*a* and 51*a* toward the distal side in the longitudinal direction when the crushing arms 11 are open, i.e., when the hydraulic cylinders 3 are closed.

The first head-side hydraulic hoses 27 and 37 have proximal caps 27*a* and 37*a* having bent shapes which have bent portions bent by 45 degrees; and distal caps 27*b* and 37*b* having straight shapes. The proximal caps 27*a* and 37*a* are connected to the distal hydraulic ports 35*e* and 35*f* provided at the swivel joint 35*a* through proximal connectors 61*a* and 71*a*. The first head-side hydraulic hoses 27 and 37 extend from the proximal connectors 61*a* and 71*a* in the hollow portion 65 in a direction inclined by about 45 degrees with respect to the longitudinal direction, are slightly curved, and then extend substantially straight toward the distal side in the longitudinal direction when the crushing arms 11 are open, i.e., when the hydraulic cylinders 3 are closed.

The second hydraulic hoses 9, 19, 29, and 39 are flexible rubber hoses. The second hydraulic hoses 9, 19, 29, and 39 include left and right second rod-side hydraulic hoses 9 and 19 that supply the hydraulic oil to and drain the hydraulic oil from the rod-side oil chambers 3*a* of the hydraulic cylinders 3; and left and right second head-side hydraulic hoses 29 and 39 that supply the hydraulic oil to and drain the hydraulic oil from the head-side oil chambers 3*b* of the hydraulic cylinders 3. The second rod-side hydraulic hoses 9 and 19 and the second head-side hydraulic hoses 29 and 39 have proximal caps 9*a*, 19*a*, 29*a*, and 39*a* having straight shapes; and distal caps 9*b*, 19*b*, 29*b*, and 39*b* having bent shapes (elbow shapes) which have bent portions bent by 90 degrees.

The proximal caps 9*a* and 19*a* of the second rod-side hydraulic hoses 9 and 19 are connected to the rod-side hydraulic ports 23*c*, which are provided at the proximal sections of the hydraulic cylinders 3, in directions orthogonal to the hydraulic cylinders 3. The proximal caps 29*a* and 39*a* of the second head-side hydraulic hoses 29 and 39 are connected to the head-side hydraulic ports 23*b*, which are provided at the proximal sections of the hydraulic cylinders 3, in the directions orthogonal to the hydraulic cylinders 3.

The second rod-side and head-side hydraulic hoses 9, 19, 29, and 39, which are connected to the head-side and rod-side hydraulic ports 23*b* and 23*c* of the hydraulic cylinders 3 at the outside of the hollow portion 65, pass through the openings 45*b* formed in the left and right side surfaces of the frame 45 (proximal portions not covered with the cover plates 55), and extend into the hollow portion 65 and then toward the distal side in the longitudinal direction while being curved.

The clamp 31 binds the distal caps 9*b*, 19*b*, 29*b*, and 39*b* of the four second hydraulic hoses 9, 19, 29, and 39 so that the distal caps 9*b*, 19*b*, 29*b*, and 39*b* are separated from the distal caps 7*b*, 17*b*, 27*b*, and 37*b* of the four first hydraulic hoses 7, 17, 27, and 37 by a predetermined distance. The clamp 31 is a disk-shaped rubber clamp. Referring to FIG. 5, the clamp 31 has four through holes 31*c*, 31*d*, 31*e*, and 31*f* extending in the longitudinal direction. The distal caps 9*b*, 19*b*, 29*b*, and 39*b* of the second hydraulic hoses 9, 19, 29, and 39 are fitted into the through holes 31*c*, 31*d*, 31*e*, and 31*f*. The through holes 31*c*, 31*d*, 31*e*, and 31*f* are separated from one another in a plane orthogonal to the longitudinal direction.

The through holes 31*c*, 31*d*, 31*e*, and 31*f* are respectively connected to notches 31*g*, 31*h*, 31*i*, and 31*j* formed at the peripheral edge of the clamp 31. The distal caps 9*b*, 19*b*, 29*b*, and 39*b* of the second hydraulic hoses 9, 19, 29, and 39 respectively pass through the notches 31*g*, 31*h*, 31*i*, and 31*j* and then are respectively fitted into the through holes 31*c*, 31*d*, 31*e*, and 31*f*. Since the distal caps 9*b*, 19*b*, 29*b*, and 39*b* of the second hydraulic hoses 9, 19, 29, and 39 are respectively fitted into the mutually separated through holes 31*c*, 31*d*, 31*e*, and 31*f*, the four second hydraulic hoses 9, 19, 29, and 39 are separated from one another by a distance that prevents the second hydraulic hoses 9, 19, 29, and 39 from being rubbed on one another.

In addition, the clamp 31 has an annular groove in the outer peripheral surface of the clamp 31 at a center portion thereof in the longitudinal direction to extend over the entire circumference thereof. A steel band 31*a* having a length adjustment screw 31*b* is fitted into the annular groove. The clamp 31 firmly binds the distal caps 9*b*, 19*b*, 29*b*, and 39*b* of the second hydraulic hoses 9, 19, 29, and 39 by clamping the steel band 31*a* by the length adjustment screw 31*b*.

The distal connectors 41*b*, 51*b*, 61*b*, and 71*b* are substantially cubical steel connectors. Each of the distal connectors 41*b*, 51*b*, 61*b*, and 71*b* has connection ports in the proximal surface and a side surface, and has therein an elbow-shaped through hole to cause these connection ports to communicate with each other.

The distal cap 7*b* of the right first rod-side hydraulic hose 7 is connected to the connection port in the proximal surface of the distal connector 41*b* located at the rear right side of the crusher. The distal cap 17*b* of the left first rod-side hydraulic hose 17 is connected to the connection port in the proximal surface of the distal connector 51*b* located at the front left side of the crusher. The distal cap 27*b* of the right first head-side hydraulic hose 27 is connected to the connection port in the proximal surface of the distal connector 61*b* located at the front right side of the crusher. The distal cap 37*b* of the left first head-side hydraulic hose 37 is connected to the connection port in the proximal surface of the distal connector 71*b* located at the rear left side of the crusher.

The distal cap 9*b* of the right second rod-side hydraulic hose 9 is connected to the connection port in the side surface of the distal connector 41*b* located at the rear right side of the crusher. The distal cap 19*b* of the left second rod-side hydraulic hose 19 is connected to the connection port in the side surface of the distal connector 51*b* located at the front left side of the crusher. The distal cap 29*b* of the second head-side hydraulic hose 29 is connected to the connection port in the side surface of the distal connector 61*b* located at the front right side of the crusher. The distal cap 39*b* of the second head-side hydraulic hose 39 is connected to the connection port in the side surface of the distal connector 71*b* located at the rear left side of the crusher.

With the structure, the hydraulic oil flowing through the first hydraulic hoses 7, 17, 27, and 37 is sent to the second hydraulic hoses 9, 19, 29, and 39 through the through holes in the distal connectors 41*b*, 51*b*, 61*b*, and 71*b*, and then is supplied to the rod-side oil chambers 3*a* and the head-side oil chambers 3*b* of the hydraulic cylinders 3. As described above, since the distal sections of the first hydraulic hoses 7, 17, 27, and 37 are connected to the distal sections of the second hydraulic hoses 9, 19, 29, and 39 through the distal connectors 41*b*, 51*b*, 61*b*, and 71*b*, both hydraulic hoses do not have to be bent with an unreasonable bend radius of a predetermined minimum radius or smaller.

Piping Structure

Joint means of the present invention corresponds to the distal caps 9*b*, 19*b*, 29*b*, and 39*b* of the second hydraulic hoses 9, 19, 29, and 39; the clamp 31; and the distal connectors 41*b*, 51*b*, 61*b*, and 71*b*. The piping structure including the joint means 9*b*, 19*b*, 29*b*, 39*b*, 31, 41*b*, 51*b*, 61*b*, and 71*b* will be described below in detail.

The second hydraulic hoses 9, 19, 29, and 39, which are connected to the head-side and rod-side hydraulic ports 23*b* and 23*c* of the hydraulic cylinders 3 outside the hollow portion 65, enter the hollow portion 65 and extend in the hollow portion 65 toward the distal side in the longitudinal direction while being curved. The clamp 31 binds straight portions (portions at the proximal side in the longitudinal direction with respect to the 90-degrees-bent portions) of the distal caps 9*b*, 19*b*, 29*b*, and 39*b* of the second hydraulic hoses 9, 19, 29, and 39 at a center portion of the hollow portion 65 in the longitudinal direction.

The distal caps 9*b*, 19*b*, 29*b*, and 39*b* of the second hydraulic hoses 9, 19, 29, and 39 bound by the clamp 31 extend outward in the directions orthogonal to the longitudinal direction to be bent at 90 degrees, are radially expanded at lower end portions of the distal caps 9*b*, 19*b*, 29*b*, and 39*b*, and are connected to the connection ports formed in the side surfaces of the distal connectors 41*b*, 51*b*, 61*b*, and 71*b*.

As described above, the distal caps 9*b*, 19*b*, 29*b*, and 39*b* of the second hydraulic hoses 9, 19, 29, and 39; the distal connectors 41*b*, 51*b*, 61*b*, and 71*b*; and the clamp 31 (the joint means) are not connected to the crusher body 5 (disconnected state), but the distal connectors 41*b*, 51*b*, 61*b*, and 71*b* are connected to the distal caps 9*b*, 19*b*, 29*b*, and 39*b* of the second hydraulic hoses 9, 19, 29, and 39, and the clamp 31 binds the distal caps 9*b*, 19*b*, 29*b*, and 39*b* of the second hydraulic hoses 9, 19, 29, and 39. Thus, the distal caps 9*b*, 19*b*, 29*b*, and 39*b* of the second hydraulic hoses 9, 19, 29, and 39; the distal connectors 41*b*, 51*b*, 61*b*, and 71*b*; and the clamp 31 (the joint means) are movable as a unit in the longitudinal direction in the hollow portion 65.

The first rod-side and head-side hydraulic hoses 7, 17, 27, and 37, which are connected to the proximal and distal hydraulic ports 35*c*, 35*d*, 35*e*, and 35*f* of the swivel joint 35*a* through the proximal connectors 41*a*, 51*a*, 61*a*, and 71*a* extend in the hollow portion 65 toward the distal side in the longitudinal direction. The distal caps 7*b*, 17*b*, 27*b*, and 37*b* of the first rod-side and head-side hydraulic hoses 7, 17, 27, and 37 are connected to the connection ports in the proximal surfaces of the distal connectors 41*b*, 51*b*, 61*b*, and 71*b*.

More specifically, the right first rod-side hydraulic hose 7 and the right first head-side hydraulic hose 27 connected to the hydraulic cylinder 3 located at the right side in the crusher left-right direction extend in the longitudinal direction between the proximal connectors 41*a*, 61*a* and the distal connectors 41*b*, 61*b* such that the right second rod-side and head-side hydraulic hoses 9, 29, which extend outside from the hollow portion 65 while being curved rightward, are interposed between the first rod-side and head-side hydraulic hoses 7 and 27 in the crusher front-rear direction. The left first rod-side hydraulic hose 17 and the left first head-side hydraulic hose 37 connected to the hydraulic cylinder 3 located at the left side in the crusher left-right direction extend in the longitudinal direction between the proximal connectors 51*a*, 71*a* and the distal connectors 51*b*, 71*b* such that the left second rod-side and head-side hydraulic hoses 19, 39, which extend outside from the hollow portion 65 while being curved leftward, are interposed between the first rod-side and head-side hydraulic hoses 17 and 37 in the crusher front-rear direction.

In short, as described above, the clamp 31 binds the distal caps 9*b*, 19*b*, 29*b*, and 39*b* of the second hydraulic hoses 9, 19, 29, and 39, and the distal caps 7*b*, 17*b*, 27*b*, and 37*b* of the first hydraulic hoses 7, 17, 27, and 37 are connected to the distal caps 9*b*, 19*b*, 29*b*, and 39*b*, the lower end portions of which are radially expanded while being bent at 90 degrees, through the distal connectors 41*b*, 51*b*, 61*b*, and 71*b*. Thus, the first hydraulic hoses 7, 17, 27, and 37 surround the second hydraulic hoses 9, 19, 29, and 39 with a predetermined distance interposed therebetween.

Operation of First and Second Hydraulic Hoses

The operation of the first hydraulic hoses 7, 17, 27, and 37, and the second hydraulic hoses 9, 19, 29, and 39 following the opening and closing operation of the hydraulic crusher 1 will be described below.

When the hydraulic oil is supplied to the head-side oil chambers 3*b* of the hydraulic cylinders 3 in the state in which the crushing arms 11 are open as shown in FIG. 2, the hydraulic cylinders 3 are expanded and the crushing arms 11 are gradually closed. At the same time, the hydraulic cylinders 3 are gradually opened to be widened toward the distal side. Hence, the right second rod-side and head-side hydraulic hoses 9 and 29 are pulled toward the right side while the left second rod-side and head-side hydraulic hoses 19 and 39 are pulled toward the left side. Since the second hydraulic hoses 9, 19, 29, and 39 extend into the hollow portion 65 of the crusher body 5 and then extend toward the distal side in the longitudinal direction while being curved, the force that pulls the second hydraulic hoses 9, 19, 29, and 39 in a direction in which the hydraulic cylinders 3 are opened is converted into the force that pulls the second hydraulic hoses 9, 19, 29, and 39 toward the proximal side in the longitudinal direction.

The second hydraulic hoses 9, 19, 29, and 39 are connected to the clamp 31 that is movable in the longitudinal direction in the hollow portion 65. Thus, even when the second hydraulic hoses 9, 19, 29, and 39 are pulled toward the proximal side in the longitudinal direction, the second hydraulic hoses 9, 19, 29, and 39 are not tensed between the hydraulic cylinders 3 and the clamp 31, but the clamp 31 is moved toward the proximal end.

Since the clamp 31 binds the distal caps 9*b*, 19*b*, 29*b*, and 39*b* of the second hydraulic hoses 9, 19, 29, and 39, the second hydraulic hoses 9, 19, 29, and 39 can be prevented from being irregularly moved (irregularly bent or twisted). In addition, since the clamp 31 is firmly fastened to the hard distal caps 9*b*, 19*b*, 29*b*, and 39*b*, the clamp 31 is moved toward the proximal side in the longitudinal direction without being inclined. Accordingly, the distal caps 9*b*, 19*b*, 29*b*, and 39*b* of the second hydraulic hoses 9, 19, 29, and 39 bound by the clamp 31, as well as the distal connectors 41*b*, 51*b*, 61*b*, and 71*b* are moved toward the proximal side in the longitudinal direction without being inclined.

As described above, since the distal connectors 41*b*, 51*b*, 61*b*, and 71*b* are moved toward the proximal side in the longitudinal direction without being inclined, the first hydraulic hoses 7, 17, 27, and 37 connected to the distal connectors 41*b*, 51*b*, 61*b*, and 71*b* are uniformly bent without being excessively bent or twisted.

When the crushing arms 11 are closed as shown in FIG. 3, that is, when the hydraulic cylinders 3 are completely opened to be widened toward the distal side, the right first rod-side hydraulic hose 7 is slightly bent toward the right side, and the left first rod-side hydraulic hose 17 is slightly bent toward the left side. Also, the right head-side hydraulic hose 27 is relatively largely bent toward the right side, and the left first head-side hydraulic hose 37 is relatively largely bent toward the left side. Since the first hydraulic hoses 7, 17, 27, and 37 surround the second hydraulic hoses 9, 19, 29, and 39 with a predetermined distance interposed therebetween as described above, the first hydraulic hoses 7, 17, 27, and 37 do not tend to be rubbed on the second hydraulic hoses 9, 19, 29, and 39.

When the crushing arms 11 are opened as shown in FIG. 2 from the closed state shown in FIG. 3, the first hydraulic hoses 7, 17, 27, and 37 and the second hydraulic hoses 9, 19, 29, and 39 are moved in a reverse manner.

Advantages

With this embodiment, the hydraulic hoses that connect the crusher body 5 with the hydraulic cylinders 3 include the first hydraulic hoses 7, 17, 27, and 37 that are connected to the proximal and distal hydraulic ports 35*c*, 35*d*, 35*e*, and 35*f* of the swivel joint 35*a*; and the second hydraulic hoses 9, 19, 29, and 39 that are connected to the head-side and rod-side hydraulic ports 23*b* and 23*c* of the hydraulic cylinders 3. Also, the distal caps 7*b*, 17*b*, 27*b*, and 37*b* of the first hydraulic hoses 7, 17, 27, and 37 are connected to the distal caps 9*b*, 19*b*, 29*b*, and 39*b* of the second hydraulic hoses 9, 19, 29, and 39 through the distal connectors 41*b*, 51*b*, 61*b*, and 71*b*. Thus, the first and second hydraulic hoses 7, 17, 27, 37, 9, 19, 29, and 39 do not have to be bent with an unreasonable bend radius of a predetermined minimum radius or smaller. The first and second hydraulic hoses 7, 17, 27, 37, 9, 19, 29, and 39 can be prevented from being damaged.

When the hydraulic cylinders 3 are opened to be widened toward the distal side, the second hydraulic hoses 9, 19, 29, and 39 are pulled toward the proximal side in the longitudinal direction by following the movement of the hydraulic cylinders 3. However, the second hydraulic hoses 9, 19, 29, and 39 are connected to the clamp 31 that is movable in the longitudinal direction in the hollow portion 65 and connected to the distal connectors 41*b*, 51*b*, 61*b*, and 71*b*. Thus, the second hydraulic hoses 9, 19, 29, and 39 can be prevented from being tensed between the hydraulic cylinders 3 and the distal connectors 41*b*, 51*b*, 61*b*, and 71*b*.

The distal caps 9*b*, 19*b*, 29*b*, and 39*b* of the second hydraulic hoses 9, 19, 29, and 39 are connected to the clamp 31 movable in the longitudinal direction and to the distal connectors 41*b*, 51*b*, 61*b*, and 71*b*. Hence, the flexibility of the second hydraulic hoses 9, 19, 29, and 39 is maintained. Therefore, when the hydraulic cylinders 3 are contracted, crushed pieces or the like do not tend to be stacked between the cylinder bodies 13 and the second hydraulic hoses 9, 19, 29, and 39. Even if crushed pieces or the like are stacked between the hydraulic cylinders 3 and the second hydraulic hoses 9, 19, 29, and 39, the second hydraulic hoses 9, 19, 29, and 39 do not tend to be damaged because of the flexibility thereof.

The second hydraulic hoses 9, 19, 29, and 39 connected to the head-side and rod-side hydraulic ports 23*b* and 23*c* of the hydraulic cylinders 3 tend to be more frequently damaged as compared with the first hydraulic hoses 7, 17, 27, and 37 connected to the proximal and distal hydraulic ports 35*c*, 35*d*, 35*e*, and 35*f* of the crusher body 5. However, since the distal caps 9*b*, 19*b*, 29*b*, and 39*b* of the second hydraulic hoses 9, 19, 29, and 39 are connected to the clamp 31 movable in the longitudinal direction and to the distal connectors 41*b*, 51*b*, 61*b*, and 71*b*, the second hydraulic hoses 9, 19, 29, and 39 can be easily replaced with new one through the opening 45*b* for the maintenance of piping.

The clamp 31 binds the distal caps 9*b*, 19*b*, 29*b*, and 39*b* of the four second hydraulic hoses 9, 19, 29, and 39 such that the distal caps 9*b*, 19*b*, 29*b*, and 39*b* are separated from the distal caps 7*b*, 17*b*, 27*b*, and 37*b* of the four first hydraulic hoses 7, 17, 27, and 37 by a predetermined distance. Thus, the second hydraulic hoses 9, 19, 29, and 39 can be prevented from being irregularly bent or twisted as a result of the movement of the hydraulic cylinders 3.

Since the distal caps 9*b*, 19*b*, 29*b*, and 39*b* of the second hydraulic hoses 9, 19, 29, and 39; the clamp 31; and the distal connectors 41*b*, 51*b*, 61*b*, and 71*b* are moved toward the proximal side in the longitudinal direction without being inclined, the four first hydraulic hoses 7, 17, 27, and 37 connected to the distal connectors 41*b*, 51*b*, 61*b*, and 71*b* are substantially uniformly bent without being excessively bent or twisted. Thus, the first hydraulic hoses 7, 17, 27, and 37 can be prevented from being too close to the second hydraulic hoses 9, 19, 29, and 39. The first hydraulic hoses 7, 17, 27, and 37 can be prevented from being rubbed on and damaged by the second hydraulic hoses 9, 19, 29, and 39.

The clamp 31 binds the distal caps 9*b*, 19*b*, 29*b*, and 39*b* of the second hydraulic hoses 9, 19, 29, and 39 such that the four second hydraulic hoses 9, 19, 29, and 39 are separated from one another. Accordingly, the second hydraulic hoses 9, 19, 29, and 39 can be prevented from being damaged because the second hydraulic hoses 9, 19, 29, and 39 repeatedly contact one another or are repeatedly separated from one another when the pair of crushing arms 11 are opened or closed.

The distal caps 9*b*, 19*b*, 29*b*, and 39*b* of the second hydraulic hoses 9, 19, 29, and 39; the clamp 31; and the distal connectors 41*b*, 51*b*, 61*b*, and 71*b* are disconnected from the crusher body 5. Accordingly, for example, an impact due to collision between the crushing arms 11 and an object to be crushed can be prevented from being directly transmitted to the joint means. Even if crushed pieces hit the member defining the hollow portion 65 of the crusher body 5 and the member is damaged, the distal caps 9*b*, 19*b*, 29*b*, and 39*b* of the second hydraulic hoses 9, 19, 29, and 39; the clamp 31; and the distal connectors 41*b*, 51*b*, 61*b*, and 71*b* can be easily prevented from being damaged. Thus, the hydraulic hoses can be further reliably prevented from being damaged.

MODIFICATIONS

The present invention is not limited to the embodiment, and may be carried out by various other configurations without departing from the scope and major feature of the present invention.

In the above-described embodiment, the joint means includes the distal caps 9*b*, 19*b*, 29*b*, and 39*b* of the second hydraulic hoses 9, 19, 29, and 39; the clamp 31; and the distal connectors 41*b*, 51*b*, 61*b*, and 71*b*. However, it is not limited thereto. The distal caps 7*b*, 17*b*, 27*b*, 37*b*, 9*b*, 19*b*, 29*b*, and 39*b* of the first and second hydraulic hoses 7, 17, 27, 37, 9, 19, 29, and 39 may be connected to a joint block that is movable in the longitudinal direction.

In the above-described embodiment, the second hydraulic hoses 9, 19, 29, and 39 are bound at the center portion of the hollow portion 65 in the longitudinal direction. However, the second hydraulic hoses 9, 19, 29, and 39 may be bound by a ring-shaped clamp to surround the first hydraulic hoses 7, 17, 27, and 37 as long as the distal sections of the four second hydraulic hoses 9, 19, 29, and 39 can be separated from the four first hydraulic hoses 7, 17, 27, and 37 by a predetermined distance.

In the above-described embodiment, the distal caps 9*b*, 19*b*, 29*b*, and 39*b* of the second hydraulic hoses 9, 19, 29, and 39 are fitted into the through holes 31*c*, 31*d*, 31*e*, and 31*f* of the clamp 31 such that the four second hydraulic hoses 9, 19, 29, and 39 are separated from one another. However, instead of this configuration, rubber portions (portions near the caps, portions near the distal sections) of the second hydraulic hoses 9, 19, 29, and 39 located at the proximal side with respect to the distal caps 9*b*, 19*b*, 29*b*, and 39*b* of the second hydraulic hoses 9, 19, 29, and 39 may be fitted into the through holes 31*c*, 31*d*, 31*e*, and 31*f* of the clamp 31.

Alternatively, two or more clamps 31 may be used. In this case, the distal caps 9*b*, 19*b*, 29*b*, and 39*b* of the second hydraulic hoses 9, 19, 29, and 39 are fitted into through holes 31*c*, 31*d*, 31*e*, and 31*f* of one of the clamps 31, and the rubber portions at the proximal side with respect to the distal caps 9*b*, 19*b*, 29*b*, and 39*b* are fitted into through holes 31*c*, 31*d*, 31*e*, and 31*f* of the other clamp 31, so that the four second hydraulic hoses 9, 19, 29, and 39 are bound at two or more positions.

In the above-described embodiment, the distal caps 9*b*, 19*b*, 29*b*, and 39*b* of the second hydraulic hoses 9, 19, 29, and 39; the clamp 31; and the distal connectors 41*b*, 51*b*, 61*b*, and

71*b* are disconnected from the crusher body 5. However, it is not limited thereto. For example, joint means may be provided so as to slide in the longitudinal direction on the frame 45.

In the above-described embodiment, the distal caps 7*b*, 17*b*, 27*b*, and 37*b* of the first hydraulic hoses 7, 17, 27, and 37 have the straight shapes, the distal caps 9*b*, 19*b*, 29*b*, and 39*b* of the second hydraulic hoses 9, 19, 29, and 39 have the elbow shapes, and the second hydraulic hoses 9, 19, 29, and 39 are arranged such that the distal sections of the distal caps 9*b*, 19*b*, 29*b*, and 39*b* of the second hydraulic hoses 9, 19, 29, and 39 are radially expanded. However, it is not limited thereto. The distal caps 7*b*, 17*b*, 27*b*, and 37*b* of the first hydraulic hoses 7, 17, 27, and 37 may have elbow shapes, the distal caps 9*b*, 19*b*, 29*b*, and 39*b* of the second hydraulic hoses 9, 19, 29, and 39 may have straight shapes, and the first hydraulic hoses 7, 17, 27, and 37 may be arranged such that the distal sections of the distal caps 7*b*, 17*b*, 27*b*, and 37*b* of the first hydraulic hoses 7, 17, 27, and 37 face the center of the hollow portion 65.

Alternatively, the distal caps 7*b*, 17*b*, 27*b*, and 37*b* of the first hydraulic hoses 7, 17, 27, and 37, and the distal caps 9*b*, 19*b*, 29*b*, and 39*b* of the second hydraulic hoses 9, 19, 29, and 39 may have straight shapes, and prism-shaped connectors may be arranged to be radially expanded so as to connect the distal caps 7*b*, 17*b*, 27*b*, and 37*b* with the distal caps 9*b*, 19*b*, 29*b*, and 39*b*.

Still alternatively, the distal caps 7*b*, 17*b*, 27*b*, and 37*b* of the first hydraulic hoses 7, 17, 27, and 37, and the distal caps 9*b*, 19*b*, 29*b*, and 39*b* of the second hydraulic hoses 9, 19, 29, and 39 may have straight shapes, and the distal caps 7*b*, 17*b*, 27*b*, and 37*b* may be connected with the distal caps 9*b*, 19*b*, 29*b*, and 39*b* by using substantially U-shaped tubes that are open toward the proximal side in the longitudinal direction.

In the above-described embodiment, the rubber clamp 31 is used; however it is not limited thereto. For example, a steel clamp may be used.

In the above-described embodiment, the distal caps 7*b*, 17*b*, 27*b*, and 37*b* of the first hydraulic hoses 7, 17, 27, and 37 are directly coupled to the proximal surfaces of the distal connectors 41*b*, 51*b*, 61*b*, and 71*b*; however, it is not limited thereto. The distal caps 7*b*, 17*b*, 27*b*, and 37*b* of the first hydraulic hoses 7, 17, 27, and 37 may be rotatably coupled to the distal connectors 41*b*, 51*b*, 61*b*, and 71*b* through a swivel. With this configuration, the first hydraulic hoses 7, 17, 27, and 37 can be prevented from being twisted. Thus, even when the opening and closing operation of the crushing arms 11 is carried out, that is, even when the distal caps 9*b*, 19*b*, 29*b*, and 39*b* of the second hydraulic hoses 9, 19, 29, and 39; the clamp 31; and the distal connectors 41*b*, 51*b*, 61*b*, and 71*b* are repeatedly moved, the first hydraulic hoses 7, 17, 27, and 37 can be reliably prevented from being damaged.

Although the invention has been described with reference to the preferred embodiments in the attached figures, it is noted that equivalents may be employed and substitutions made herein without departing from the scope of the invention as recited in the claims.

What is claimed is:

1. A hydraulic crusher detachably attached to a distal section of an arm of a working machine, the hydraulic crusher comprising:

a pair of crushing arms configured to grip and crush an object to be crushed;

a crusher body, a proximal section of the crusher body attached to the distal section of the arm of the working machine, the proximal section of the crusher body having ports, a distal section of the crusher body supporting the crushing arms in an openable and closable manner around pivots, the crusher body having a hollow portion between the distal section and the proximal section of the crusher body, the hollow portion extending in a longitudinal direction defined by connecting the distal section with the proximal section of the crusher body;

a pair of hydraulic cylinders, proximal sections of the hydraulic cylinders coupled to the proximal section of the crusher body outside the hollow portion rotatably around pivots, the proximal sections of the hydraulic cylinders having ports, distal sections of the hydraulic cylinders respectively coupled to the crushing arms rotatably around pivots;

a plurality of first hydraulic hoses having proximal caps connected to the ports at the proximal section of the crusher body, the first hydraulic hoses extending toward a distal side in the longitudinal direction in the hollow portion;

a plurality of second hydraulic hoses having proximal caps connected to the ports at the proximal sections of the hydraulic cylinders, the second hydraulic hoses extending into the hollow portion and then extending toward the distal side in the longitudinal direction while being curved; and joint means movable in the longitudinal direction in the hollow portion, the joint means connecting distal sections of the first hydraulic hoses with distal sections of the second hydraulic hoses.

2. The hydraulic crusher according to claim 1, wherein the joint means binds the distal sections and/or portions near the distal sections of the second hydraulic hoses such that the distal sections of the second hydraulic hoses are separated from the distal sections of the first hydraulic hoses by a predetermined distance.

3. The hydraulic crusher according to claim 2, wherein the joint means binds the distal sections and/or the portions near the distal sections of the second hydraulic hoses such that the second hydraulic hoses are separated from one another.

4. The hydraulic crusher according to claim 1, wherein the joint means is disconnected from the crusher body.

5. The hydraulic crusher according to claim 1, wherein the first hydraulic hoses have distal caps coupled to the joint means rotatably relative to the joint means.

6. The hydraulic crusher according to claim 1, wherein the joint means includes, elbow-shaped distal caps of the second hydraulic hoses, a clamp that binds the distal caps and/or portions near the distal caps of the second hydraulic hoses, and connectors to which the distal caps of the second hydraulic hoses are connected in a direction orthogonal to the longitudinal direction, and to which distal caps of the first hydraulic hoses are connected from the proximal side in the longitudinal direction.

7. The hydraulic crusher according to claim 6, wherein the clamp has a plurality of through holes separated from one another in a plane orthogonal to the longitudinal direction and extending in the longitudinal direction, and the distal caps and/or the portions near the distal caps of the second hydraulic hoses are fitted into the through holes.

* * * * *